US009283802B2

(12) United States Patent
Briggl

(10) Patent No.: US 9,283,802 B2
(45) Date of Patent: Mar. 15, 2016

(54) WRITING INSTRUMENT

(75) Inventor: Hariolf Briggl, Bobingen (DE)

(73) Assignee: Klio-Eterna Schreibgeräte GmbH & Co KG, Wolfach (DE)

( * ) Notice: Subject to any disclaimer, the term of this patent is extended or adjusted under 35 U.S.C. 154(b) by 286 days.

(21) Appl. No.: 13/816,592

(22) PCT Filed: Jul. 6, 2011

(86) PCT No.: PCT/EP2011/003360

§ 371 (c)(1), (2), (4) Date: Feb. 12, 2013

(87) PCT Pub. No.: WO2012/019679

PCT Pub. Date: Feb. 16, 2012

(65) Prior Publication Data

US 2013/0142562 A1 Jun. 6, 2013

(30) Foreign Application Priority Data

Aug. 12, 2010 (DE) ..... 20 2010 011 339 U

(51) Int. Cl.

| | |
|---|---|
| ***B43K 24/00*** | (2006.01) |
| ***B43K 7/00*** | (2006.01) |
| ***B43K 7/12*** | (2006.01) |
| ***B43K 8/00*** | (2006.01) |
| ***B43K 21/00*** | (2006.01) |
| ***B43K 24/08*** | (2006.01) |
| ***B43K 29/08*** | (2006.01) |

(52) U.S. Cl.

CPC ..... *B43K 24/00* (2013.01); *B43K 7/005* (2013.01); *B43K 7/12* (2013.01); *B43K 8/003* (2013.01); *B43K 21/006* (2013.01); *B43K 24/08* (2013.01); *B43K 29/08* (2013.01)

(58) Field of Classification Search

CPC ..... B43K 29/00; B43K 29/08
USPC ..... 401/195; D19/123, 128
See application file for complete search history.

(56) References Cited

U.S. PATENT DOCUMENTS

| | | | | |
|---|---|---|---|---|
| 6,132,125 | A * | 10/2000 | Lin | 401/195 |
| 6,773,192 | B1 | 8/2004 | Chao | |
| 6,905,352 | B2 * | 6/2005 | Chao | 401/195 |
| 6,932,276 | B1 * | 8/2005 | Liu | B43K 29/093 235/486 |
| D545,896 | S * | 7/2007 | Qiu | D14/480.3 |
| D562,384 | S * | 2/2008 | Qiu | D14/480.3 |
| 7,347,638 | B1 * | 3/2008 | Lin | B43K 27/00 340/321 |

(Continued)

FOREIGN PATENT DOCUMENTS

| | | |
|---|---|---|
| DE | 3319994 | 12/1983 |
| DE | 20201024 | 5/2002 |
| DE | 202008017711 | 5/2010 |

*Primary Examiner* — Jennifer C Chiang
*Assistant Examiner* — Bradley Oliver
(74) *Attorney, Agent, or Firm* — Volpe and Koenig, P.C.

(57) ABSTRACT

A writing instrument (1) having a writing instrument housing (3), with a writing nib (8) protruding beyond one end of said writing instrument housing, wherein the writing instrument (1) has a machine-readable data memory. The invention provides a functional element (5) at that end of the writing instrument housing (3) which is remote from the writing nib (8) and attaching at least one subregion of the functional element (5) to the writing instrument (1) in a detachable manner, and allowing the functional element (5) or its detachably attached subregion to contain the machine-readable data memory.

5 Claims, 3 Drawing Sheets

(56) References Cited

U.S. PATENT DOCUMENTS

| | | | | | |
|---|---|---|---|---|---|
| 7,401,992 | B1 * | 7/2008 | Lin | B43K 23/126 | 401/131 |
| 7,802,909 | B2 * | 9/2010 | Baker | A61B 1/227 | 362/183 |
| D669,900 | S * | 10/2012 | Schlossstein | D14/480.3 | |
| D669,902 | S * | 10/2012 | Schlossstein | D14/480.3 | |
| D669,903 | S * | 10/2012 | Schlossstein | D14/480.3 | |
| D679,718 | S * | 4/2013 | Benois | D14/480.3 | |
| D715,311 | S * | 10/2014 | Briggl | D14/480.3 | |
| 2004/0233629 | A1 * | 11/2004 | Wang | B43K 29/08 | 361/679.4 |
| 2005/0083315 | A1 * | 4/2005 | Pei | B43K 7/005 | 345/179 |
| 2006/0280047 | A1 | 12/2006 | Yu | | |

* cited by examiner

WRITING INSTRUMENT

BACKGROUND

The invention relates to a writing instrument, which is formed as a pushbutton writing instrument and has a writing instrument housing, with a writing tip protruding beyond one end of said housing, which writing tip can be moved by means of a pushing mechanism between a writing position, projecting beyond one end of the writing instrument housing, and a standby position, located in the housing interior of the writing instrument housing, the pushing mechanism being able to be actuated by means of a pushbutton intended as a functional element, which is provided at the end of the writing instrument housing that is remote from the writing tip and which has a first pushbutton subregion, which is in drive connection with the pushing mechanism and to which a second pushbutton subregion can be detachably fastened.

DE 202 01 024 U1 already discloses a writing instrument having a writing instrument housing, which comprises two housing parts connected to each other. Integrated in the housing part that is remote from the writing tip is a machine-readable data memory, the interface device of which that is intended for connecting to an external data processing system and is designed as a USB interface is arranged in a protected manner in the connecting region of the two housing parts. In order to connect the data memory to the external data processing system, it is necessary to dismantle the writing instrument housing into its two housing parts and expose the USB interface provided on the one housing part. However, it is disadvantageous that, after dismantling the writing instrument housing, the remaining housing part with the writing tip can scarcely continue to be used as intended as a writing instrument; the previously known writing instrument is therefore only able to be used either as a writing instrument, with the writing instrument housing assembled, or as a machine-readable data memory, whereas the two functions are not available at the same time.

U.S. Pat. No. 6,773,192 B1 also already discloses a writing instrument having a writing instrument housing, which has a machine-readable data memory in its housing interior. For this purpose, the writing instrument housing is divided into two housing halves, which can be screwed together at their mutually facing ends. The data memory protrudes with its data memory connection beyond the end of the first housing half that is remote from a clip of the writing instrument, while the other, second housing half has at its end remote from the writing tip an inner cavity, into which the data memory connection protruding from the first housing half can extend in the screwed-together state of the writing instrument housing. In order to be able to use the data memory and connect its data memory connection to a data processing system, it is necessary to unscrew the housing halves and expose the data memory connection. However, it is disadvantageous that, when the writing instrument housing is unscrewed, the previously known writing instrument is temporarily scarcely available as a writing instrument in any meaningful way until the data storage operation can be completed. Since the writing instrument housing of the previously known writing instrument is divided into two housing halves, the housing half having the writing tip is too short to offer the user the required writing comfort.

DE 20 2008 017 711 U1 already discloses a writing instrument having a writing instrument housing, detachably fastened to which is a clip which contains a machine-readable data memory. In order to be able to use this machine-readable data memory in connection with an external data processing system, all that is required is to detach the clip from the writing instrument housing. The writing instrument previously known from DE 20 2008 017 711 U1 does offer the advantage that it can be used as a writing instrument while the data memory detachably held on it can also be used at the same time. However, the writing instrument can no longer be secured with the aid of the clip in the accustomed way to prevent loss if it is intended for the data memory to continue being used.

DE 33 19 994 A1 already describes a writing instrument which is designed as a pushbutton pencil. The previously known pushbutton pencil has a writing instrument housing, with a writing tip protruding beyond the end of said housing, which writing tip can be moved by means of a pushing mechanism between a writing position, projecting beyond one end of the writing instrument housing, and a standby position, located in the housing interior. The pushing mechanism can be actuated by means of a pushbutton intended as a functional element, which is provided at the end of the writing instrument housing that is remote from the writing tip. The pushbutton has a first pushbutton subregion, which is in drive connection with the pushing mechanism and carries an eraser. In order to protect the eraser while the previously known pushbutton pencil is being transported, a second pushbutton subregion is provided, given the form of a cap and able to be detachably fastened to the first pushbutton subregion in such a way that, in its position connected to the first pushbutton subregion, the second pushbutton subregion accommodates the eraser within it.

In the case of the pushbutton pencil previously known from DE 33 19 994 A1, the function of the second pushbutton subregion is restricted to covering the eraser in a protective manner in the position in which it is connected to the first pushbutton subregion, the eraser, which offers the user an additional significant function, remaining constantly connected to the first pushbutton subregion, and consequently to the writing instrument itself. During use, the user must therefore decide whether he either wishes to write with the writing tip or instead correct the writing with the eraser provided at the opposite end. Accommodating a data memory is not mentioned in DE 33 19 994 A1, let alone provided.

SUMMARY

There is therefore the object in particular of providing a writing instrument of the type mentioned at the beginning that allows its machine-readable data memory to be used at the same time as the writing instrument is being used, without any further functional drawbacks.

The solution according to the invention for achieving this object in the case of the writing instrument of the type mentioned at the beginning consists in particular in that the writing instrument has a machine-readable data memory, and in that for this purpose the second pushbutton subregion, provided as a detachably fastenable subregion of the functional element, contains the data memory.

In the case of the writing instrument according to the invention, a pushbutton intended as a functional element is provided at the end of the writing instrument housing that is remote from the writing tip.

This pushbutton has a first pushbutton subregion, which is in drive connection with the pushing mechanism and to which a second pushbutton subregion can be detachably fastened. In this case, the second pushbutton subregion, provided as a detachably fastenable subregion of the functional element, contains the data memory. The arrangement of the data memory in the second pushbutton subregion that is detachable from the writing instrument makes it possible to use the data memory with an external data processing system without having to accept functional drawbacks with respect to the writing instrument itself that can be used at the same time. Since the data memory is integrated at the end remote from the writing tip, and consequently only in a limited subregion of the writing instrument, it is not necessary for the writing instrument housing that also serves at the same time as a grip to be divided into two, and for example a clip that is possibly provided on the writing instrument housing also continues to be available without any restrictions, if so required.

Since the writing instrument according to the invention is formed as a pushbutton writing instrument, the writing tip can be accommodated in a protected manner in the housing interior of the writing instrument housing when not in use.

A preferred embodiment in which the pushing mechanism of the pushbutton writing instrument can be used independently of whether the data memory located in the pushbutton or the detachably fastenable second pushbutton subregion thereof is in use provides that, when the second pushbutton subregion is detached from the writing instrument, the pushing mechanism can be actuated at the first pushbutton subregion, which first pushbutton subregion is preferably displaceably guided on the writing instrument housing.

It is advantageous if the functional element or the detachably fastenable subregion thereof has a data transmission interface or similar interface device for reading from and writing to the data memory. In this case, the interface device in the functional element or the detachably fastenable subregion thereof may be designed in the manner of a USB and/or FireWire and/or Bluetooth and/or infrared and/or some other data transmission interface format.

In order that the writing instrument has a form that does not make the multifunctionality of the writing instrument immediately evident in particular when the data memory is not in use, in order to give the writing instrument a form that is as attractive as possible and in order at the same time also to accommodate the data memory and the interface device thereof in a protected manner, it is advantageous if an interface device intended for connection to an external data processing system is provided on the detachably fastenable second pushbutton subregion and if the interface device is accommodated in a protected manner in the first pushbutton subregion in a retaining position of the second pushbutton subregion that is detachably fastened to the first pushbutton subregion.

A preferred embodiment according to the invention provides that the writing instrument is designed as a pencil and/or as a ballpoint pen, a fiber-tip pen or a gel pen.

BRIEF DESCRIPTION OF THE DRAWINGS

Developments according to the invention are evident from the following description of the figures and the claims. The invention is described in more detail below on the basis of a preferred exemplary embodiment.

In the figures.

DETAILED DESCRIPTION OF THE PREFERRED EMBODIMENTS

Figure 1:
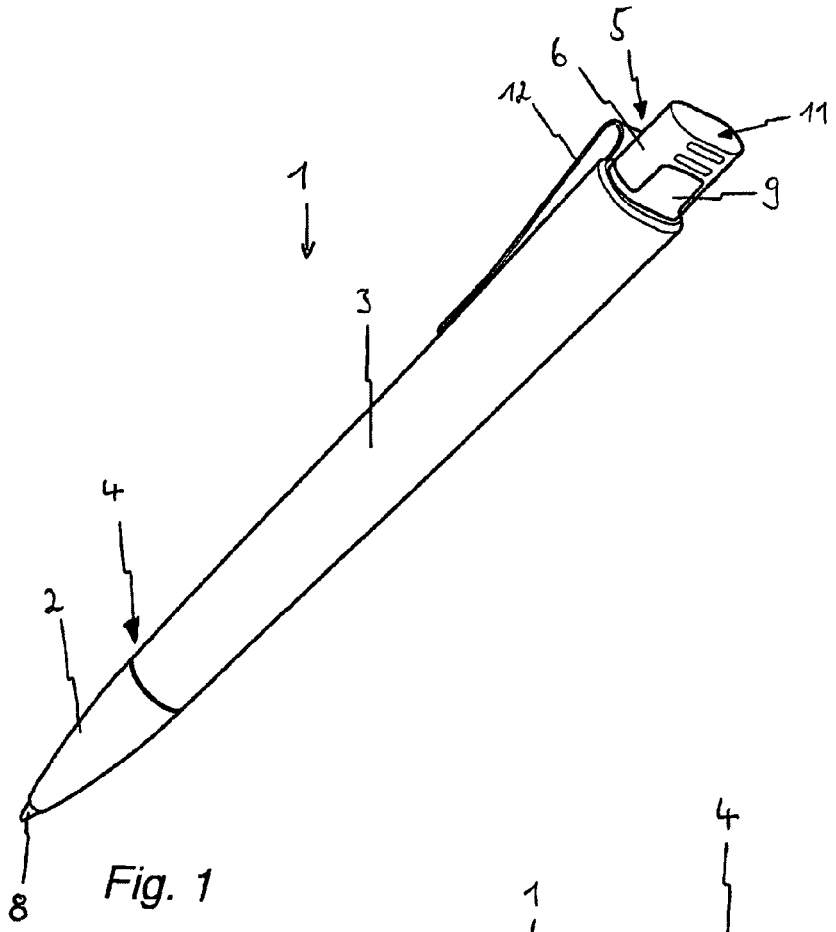
FIG. 1 shows a perspective representation of a writing instrument having a functional element which, in the not-in-use position, is retracted at the end opposite from the writing tip, contains a machine-readable data memory and also serves as a pushbutton or pressing element for the actuation of the pushing mechanism of the writing instrument that is located in the housing interior.
Figure 2:
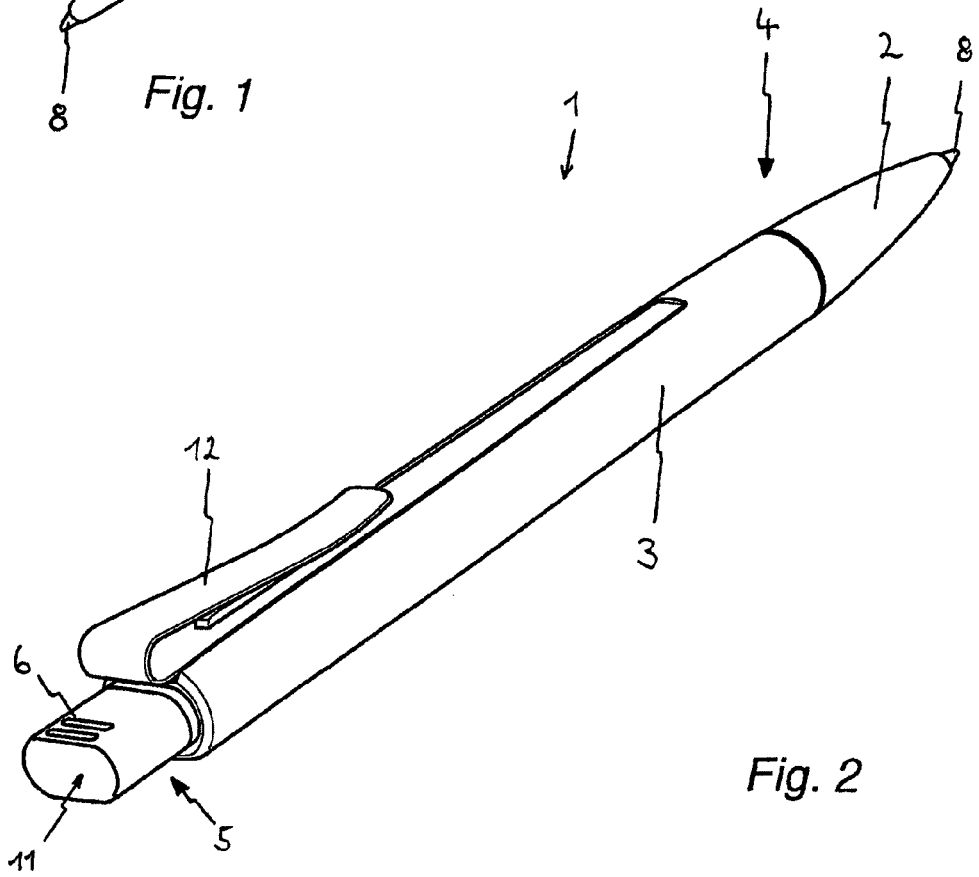
FIG. 2 shows another perspective view of the writing instrument represented in FIG. 1, in the case of which a clip fastened to the outside of the housing can be seen.

Represented in FIGS. 1 to 10 is a writing instrument 1 having a writing instrument housing 3, with a writing tip 8 protruding beyond one end of said housing. The writing instrument 1 has a machine-readable data memory at the end of the writing instrument housing 3 that is remote from the writing tip 8. For this purpose, a functional element 5 is provided at the end of the writing instrument housing 3 that is remote from the writing tip 8. At least a subregion 6 of the functional element 5 can be detachably fastened to the writing instrument housing 3. The functional element 5 or its detachably fastenable subregion 6 contains the aforementioned machine-readable data memory.

The writing instrument 1 represented in FIGS. 1 to 10 is formed as a pushbutton writing instrument, the writing tip 8 of which can be moved by means of a pushing mechanism located here in the housing interior of the writing instrument housing 3 between a writing position, projecting beyond one end of the writing instrument housing 3, and a standby position, located in the housing interior of the writing instrument housing 3.

The pushing mechanism can be actuated by means of a pushbutton, which is arranged at the end of the writing instrument housing 3 that is remote from the writing tip 8 and serves as a functional element 5 of the pushbutton writing instrument 1. As becomes clear from FIGS. 3 and 4, the pushbutton 5 has a first pushbutton subregion 9, which is in driving connection with the pushing mechanism and is displaceably guided in the writing instrument housing 3 at the end remote from the writing tip 8. A second pushbutton subregion 6, which contains the data memory, can be detachably fastened to the first pushbutton subregion 9.

The second pushbutton subregion 6, having the data memory, is designed in the manner of a USB stick and has an interface device 7 designed as a USB data transmission interface format.

Figure 3:
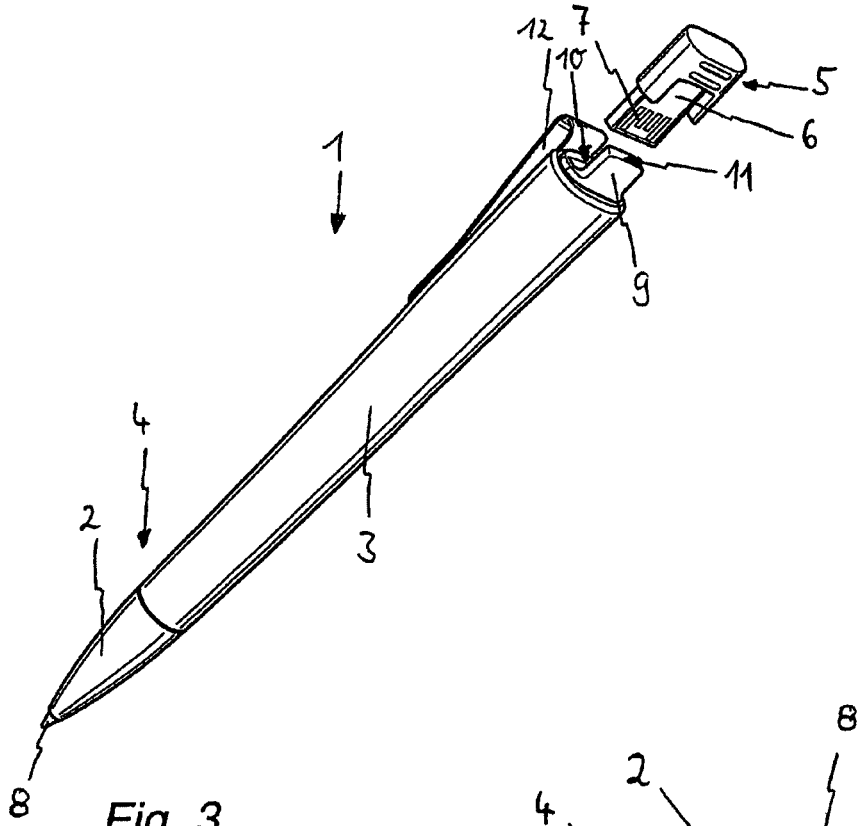
FIG. 3 shows a perspective representation of the writing instrument according to FIGS. 1 and 2 in which the functional part containing the data memory has been detached from the writing instrument and removed.
Figure 4:
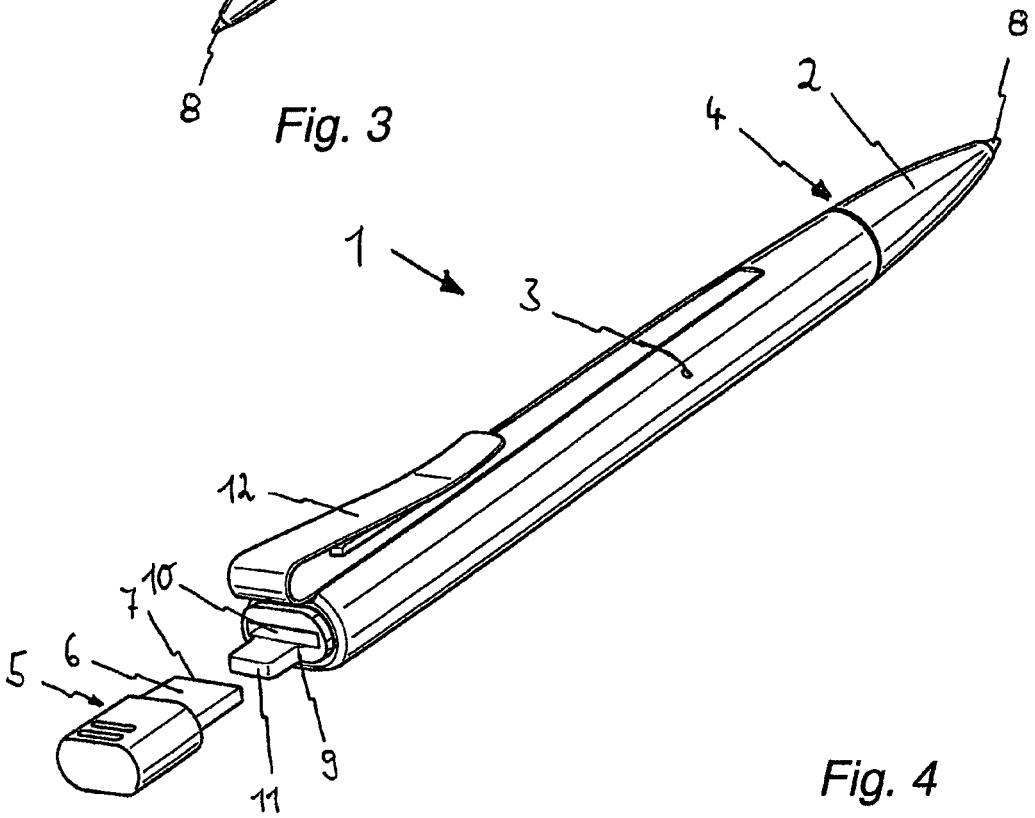
FIG. 4 shows a view identical to the representation in FIG. 2 of the writing instrument with the functional element removed.
Figure 5:
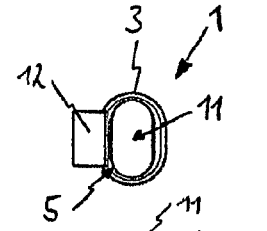
FIG. 5 shows a representation directed toward the end of the writing instrument having the functional element.
Figure 6:
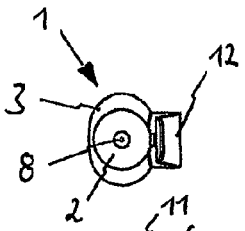
FIG. 6 shows a representation of the writing instrument from FIGS. 1 to 5 that is directed toward the writing tip.
Figure 7:
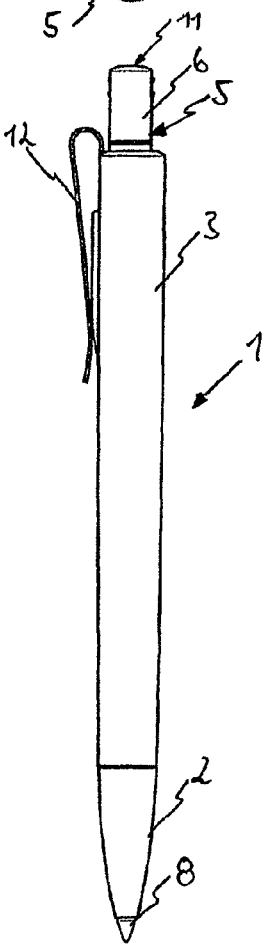
FIG. 7 shows a side view of the writing instrument shown in FIGS. 1 to 6, the functional element having the data memory being fitted on the writing instrument.
Figure 8:
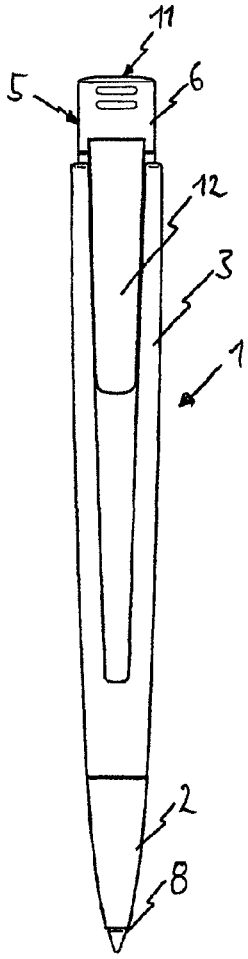
FIG. 8 shows a frontal view of the writing instrument from FIGS. 1 to 7 that has been turned to the right by 90° in relation to FIG. 7, the clip being easy to see.
Figure 9:
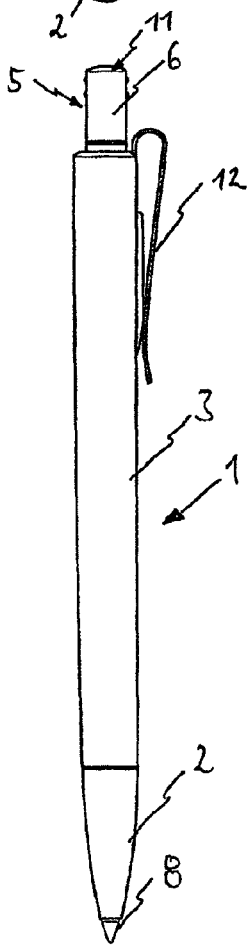
FIG. 9 shows a side view of the writing instrument that has been turned by 180° about the longitudinal center axis in relation to FIG. 7.
Figure 10:
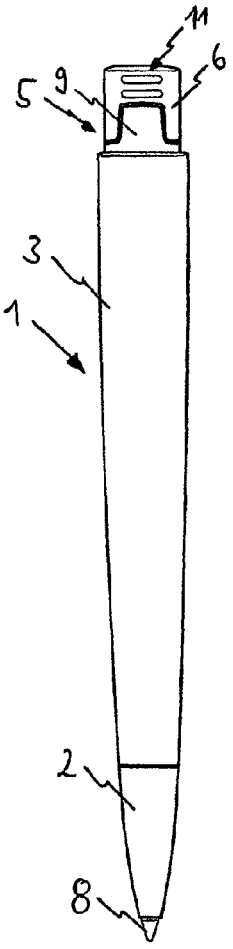
FIG. 10 shows a side view of the writing instrument from FIGS. 1 to 9 that has been turned by 180° about the longitudinal center axis in relation to FIG. 8.

In FIGS. 3 and 4 it can be seen that the one pushbutton subregion, here the first pushbutton subregion 9, has a receiving opening 10, into which the other pushbutton subregion, here the second pushbutton subregion 6, can be inserted with a form fit in such a way that the complementary shapings of the pushbutton subregions 6, 9 together make up a preferably cylindrical pushbutton 5, this pushbutton 5 having a cross section that remains the same over the predominant portion of its longitudinal extent. If the second pushbutton subregion 6 is detached from the writing instrument 1, the pushing mechanism located in the housing interior of the writing instrument housing 3 can be actuated at the first pushbutton subregion 9, which is displaceably guided on the writing instrument housing 3. The first pushbutton subregion 9 has for this purpose a first finger-engagable region 11, which protrudes beyond the end of the writing instrument housing 3 that is remote from the writing tip 8. The second pushbutton subregion 6 also includes a second finger-engagable region that protrudes beyond the second end of the writing instrument housing that is complementary to and engagable with the first finger-engagable region 11 to form an external portion of the pushbutton. It can be seen in FIGS. 3 and 4 that the interface device 7 intended for connection to an external data processing system is provided on the detachably fastenable second pushbutton subregion 6 and that the interface device 7 is accommodated in a protected manner in the first pushbutton subregion 9 in a retaining position of the second pushbutton subregion 6 that is detachably fastened to the first pushbutton subregion 9. The first pushbutton subregion 9 has for this purpose a receiving opening 10, into which the interface device 7 protruding beyond the second pushbutton subregion 6 can be inserted. In the case of an embodiment according to the invention that is not represented any further, the functional element 5 receiving the machine-readable data memory may be designed such that it can be screwed into a counterpart on the writing instrument 1, whereby still better fastening to the writing instrument housing 3 can be achieved if required.

As already mentioned, in the exemplary embodiment represented the machine-readable data memory is a data memory device with a data transmission interface in the manner of a USB interface. Depending on requirements, however, it is also possible to provide the writing instrument 1 with a data transmission interface in the form of a FireWire and/or Bluetooth and/or infrared and/or other data transmission interface format.

According to FIGS. 2, 4, 7 and 9, a retaining clip 12 is arranged on the writing instrument housing 3 in the region of the functional element 5, on the outer side of the housing body. This clip may also be substituted by a retaining eyelet. If the writing instrument 1 is designed with a wireless data transmission interface 7 in particular—for example a Bluetooth and/or an infrared interface—a power source in the form of a battery or a storage battery may be provided in the housing interior of the writing instrument housing 3, or in the interior of the functional element 5, for operating the data transmission interface 7. The writing instrument 1, which is formed here as a pushbutton ballpoint pen or as a pushbutton pencil, has here a multipart writing instrument housing 3 with a front housing part 2, enclosing the writing tip 8 and serving as a grip, and a tubular housing body connected thereto, which are connected to each other in the region of the separating line 4. The writing tip 8 may be designed as the tip of a ballpoint-pen refill cartridge or pencil lead.

The invention claimed is:

1. A writing instrument (1), which is formed as a pushbutton writing instrument comprising a writing instrument housing (3), with a writing tip (8) protruding beyond one end of said housing, said writing tip being movable by a pushing mechanism between a writing position, projecting beyond one end of the writing instrument housing (3), and a standby position, located in a housing interior of the writing instrument housing (3), the pushing mechanism being actuatable by a pushbutton (5) that is a functional element, which is provided at a second end of the writing instrument housing (3) that is remote from the writing tip (8), the pushbutton (5) includes a first pushbutton subregion (9) that is displaceably guided in the writing instrument housing (3) and having a first finger-engagable region that protrudes beyond the second end of the writing instrument housing (3) and a receiving opening (10) that extends to a region within the writing instrument housing, the first pushbutton subregion (9) is in driving connection with the pushing mechanism, a second pushbutton subregion (6) is detachably fastened to the first pushbutton subregion (9), the second pushbutton subregion (6) including a second finger-engagable region that protrudes beyond the second end of the writing instrument housing (3) and is complementary to and engagable with the first finger-engagable region to form an external portion of the pushbutton, and a machine-readable data memory connected to the second finger-engagable region and removably insertable into the receiving opening (10) such that the machine-readable data memory extends within the writing instrument housing (3), and the first finger-engagable region allowing actuation of the pushing mechanism upon removal of the second pushbutton subregion (6).

2. The writing instrument as claimed in claim 1, wherein the functional element (5) or the detachably fastenable subregion (6) thereof has a data transmission interface or interface device (7) for reading from and writing to the data memory.

3. The writing instrument as claimed in claim 2, wherein the data transmission interface or interface device (7) in the functional element (5) or the detachably fastenable subregion (6) thereof is a USB, FireWire, Bluetooth, infrared, or other data transmission interface format.

4. The writing instrument as claimed in claim 1, wherein an interface device (7) adapted for connection to an external data processing system is provided on the detachably fastenable second pushbutton subregion (6), and the interface device (7) is accommodated in a protected manner in the receiving opening in a retaining position of the second pushbutton subregion (6) that is detachably fastened to the first pushbutton subregion (9).

5. The writing instrument as claimed in claim 1, wherein the writing instrument (1) is a pencil, a ballpoint pen, a fiber-tip pen, or a gel pen.

* * * * *